US006064012A

United States Patent [19]

Beard et al.

[11] Patent Number: 6,064,012

[45] Date of Patent: May 16, 2000

[54] COMMON TRIP BAR AND TRIP LEVERS FOR ELECTRIC CIRCUIT BREAKERS

[75] Inventors: David M. Beard, Doraville; Parker A. Bollinger, Jr., Stone Mountain, both of Ga.

[73] Assignee: Siemens Energy & Automation, Inc., Alpharetta, Ga.

[21] Appl. No.: 09/324,676

[22] Filed: Jun. 3, 1999

[51] Int. Cl.[7] ..... H01H 75/00; H01H 9/26

[52] U.S. Cl. ..... 200/50.32; 335/9

[58] Field of Search ..... 200/17 R, 50.01, 200/50.32–50.35, 50.37, 50.39, 50.4; 218/1, 2, 5, 7, 22, 23, 154; 335/7–10, 17, 132, 172, 189–191, 37–40

[56] References Cited

U.S. PATENT DOCUMENTS

| | | | |
|---|---|---|---|
| 4,112,270 | 9/1978 | Rys | 200/50 C |
| 4,137,437 | 1/1979 | Maier et al. | 200/153 |
| 4,524,339 | 6/1985 | Chabot | 335/22 |
| 4,580,021 | 4/1986 | Fujikake | 200/153 |
| 4,727,226 | 2/1988 | Comtois et al. | 200/50 C |
| 5,057,806 | 10/1991 | McKee et al. | 335/9 |
| 5,157,366 | 10/1992 | Mullins et al. | 335/8 |
| 5,557,082 | 9/1996 | Leet et al. | 200/50.35 |
| 5,910,757 | 6/1999 | Broghammer et al. | 335/9 |

*Primary Examiner*—Michael Friedhofer
*Attorney, Agent, or Firm*—Ira Lee Zebrak

[57] ABSTRACT

A crossbar or trip bar for spanning the poles of a multi-pole electric circuit breaker and a plurality of trip levers each having a slot formed by interior walls with a plurality of tapered ribs for compressing the outer surface of the trip bar and security the trip bar and trip levers together.

20 Claims, 2 Drawing Sheets

COMMON TRIP BAR AND TRIP LEVERS FOR ELECTRIC CIRCUIT BREAKERS

FIELD OF THE INVENTION

The present invention relates to electrical switching gear and electric circuit breakers, and more particularly to common trip bar or crossbar member and trip levers for an electric circuit breaker.

BACKGROUND OF THE INVENTION

In view of the purpose and functions of a circuit breaker, it is important that the contacts of a circuit breaker are separated quickly when circuit interruption is initiated. For multi-pole circuit breakers, a common trip bar or crossbar allows the poles of the circuit breaker to trip if not simultaneously, virtually simultaneously. The common trip bar or crossbar transfers the motion of one pole's trip lever to that of the other poles in the circuit breaker, causing them to trip as well. If the common trip bar or crossbar fits too loosely within one or more of the trip levers of a multi-pole circuit breaker, there may be insufficient motion of the poles' trip levers to trip the poles.

In a multi-pole circuit breaker with common trip bar or crossbar, an actuator in the first pole to trip drives the trip lever for that pole to a tripped position. That trip lever drives the common trip bar or crossbar which in turn drives the trip lever(s)for the remaining pole(s). If the remaining pole(s) contains a mechanism, that pole's trip lever typically engages a latch, releasing the mechanism(s) and causing that pole trip. Some trip lever/bar designs have trip bars which are not integral units such as when they are not molded together but the trip bar is separate from the levers. An advantage of multi-piece design is that it permits using electrically conducting materials, when required for strength or rigidity, to be used for the trip lever or bar, without risk of phase-to-phase shorting. Additionally, it allows breaker poles to be assembled individually then assembled together with the trip bar in place. One disadvantage of the multi-piece design is that because of the manufacturing tolerances of the parts, the trip bar can mate loosely with the levers. If the available driving motion is limited and the looseness of the fit between components of a multi-piece design is too great, the driven trip lever(s) may have insufficient motion to trip its pole(s).

For example, if a trip lever rotates about a pivot, it moves the bar and the driven trip lever through angular displacements. Looseness between the parts reduces the angular displacement at the driven trip lever. Prior art designs have attempted to compensate for the loss of motion using the following techniques.

One is to change the part that moves the driving trip lever to increase input motion to the assembly. This frequently requires expensive tooling changes and/or may change the part to such a degree that it won't work in other applications.

Another prior art design is to shorten the trip lever so the same input motion provides a greater angular rotation to the assembly, so the rotation lost due to looseness has less effect. However, the room required to accomplish this frequently does not exist, part interferences oftentimes result, or tooling changes are required.

Further, prior art attempts have been to specify lower tolerances for the mating parts but the part cost usually increases.

SUMMARY OF THE INVENTION

In accordance with the present invention, a crossbar and trip lever assembly for a multi-pole electric circuit breaker is provided comprising a longitudinally extending deformable tubular trip bar of hollow cross section and having an outer surface for insertion into a plurality of trip levers, and a plurality of trip levers each having a drive slot formed by interior walls with a plurality of tapered ribs partially extending longitudinally on the interior walls into the drive slot for compressing the outer surface of the trip bar.

DETAILED DESCRIPTION OF THE INVENTION

In accordance with the present invention, the assemblage of the common trip bar or crossbar with the trip lever of multi pole circuit breaker is accomplished by utilizing a press fit of a collapsible tubular trip bar into the trip levers where the trip levers have a drive slot with tapered ribs into which the trip bar of hollow cross section is secured so that no free movement between the levers and the bar is allowed.

Although one way to obtain a press fit is to make the trip lever out of a flexible thermoplastic material which deforms when a rigid bar is inserted, the present inventors have discovered that a flexible trip lever might distort from a press fit causing it not to function as required. Furthermore, and more importantly, the operating temperature of circuit breakers can limit the choice of plastic for trip levers or bars to thermosets. Since thermosets are brittle, parts made from them aren't flexible enough to deflect as required for a press fit. Accordingly, in a preferred embodiment of the present invention, the trip bar is made of a ductile material and the trip levers are made of a rigid plastic.

Functionally, as the tubular trip bar is inserted into the drive slot, the tapered ribs in the drive slot compress the walls of the tube where the deflection of the tube's walls provide the pressure for the press fit avoiding the need for any additional springs, etc.

Figure 1:
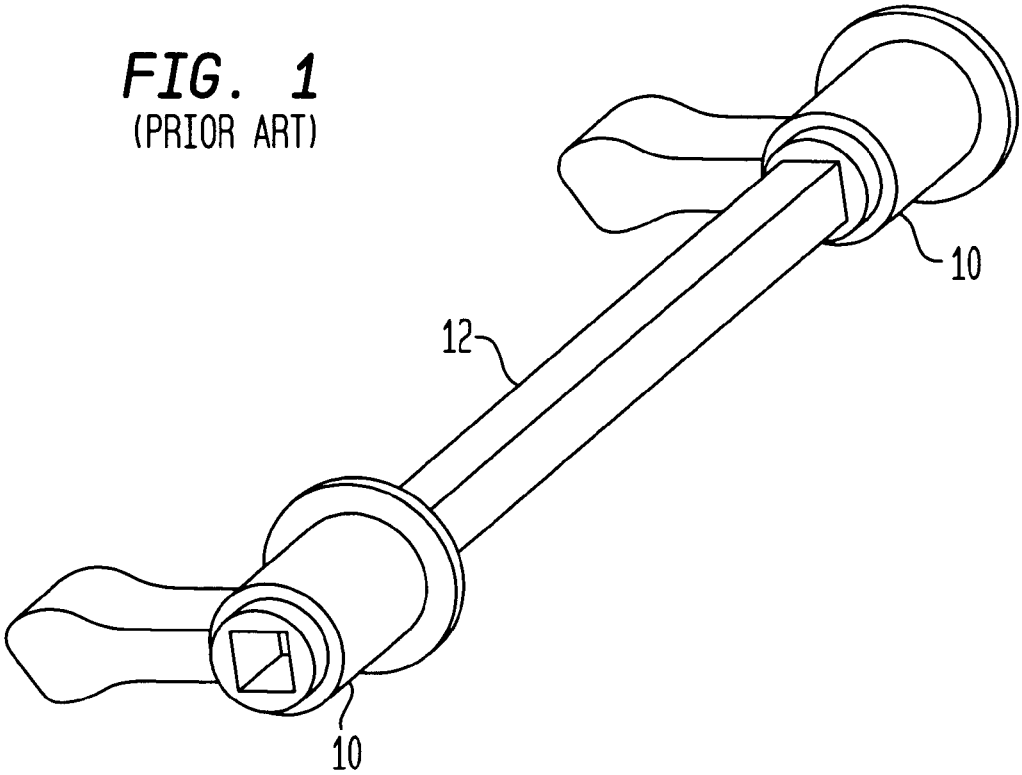
FIG. 1 (PRIOR ART)
FIG. 1 shows an assembled trip bar and trip levers typical of prior art circuit breakers.

Referring to the figures, FIG. 1 shows a trip bar and trip levers typical of many prior art circuit breakers such as those disclosed in U.S. Pat. Nos. 4,580,021; 4,137,437; 4,524,339 which are hereby incorporated by reference.

Figure 2:
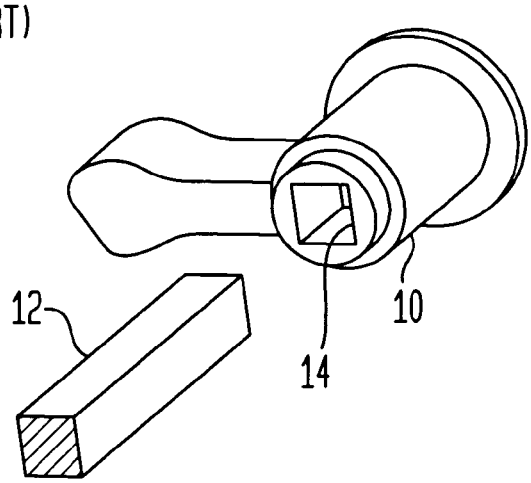
FIG. 2 (PRIOR ART)
FIG. 2 shows a trip bar positioned as it is inserted into a drive slot in the trip lever.

FIG. 1 shows the outside trip levers 10 and bar 12 assembly for a common trip quad circuit breaker. This assembly allows the two outside poles of a 4-pole circuit breaker assembly to trip simultaneously. FIG. 2 shows bar 12 positioned as it is to be inserted into a drive slot 14 in trip lever 10. As stated above, the tightest fit possible is desired since the driving lever is rotated by its actuator though a limited angle. However, allowing enough clearance for the bar to fit into the lever for all tolerance conditions results in an assembly with too much angular looseness.

Figure 3:
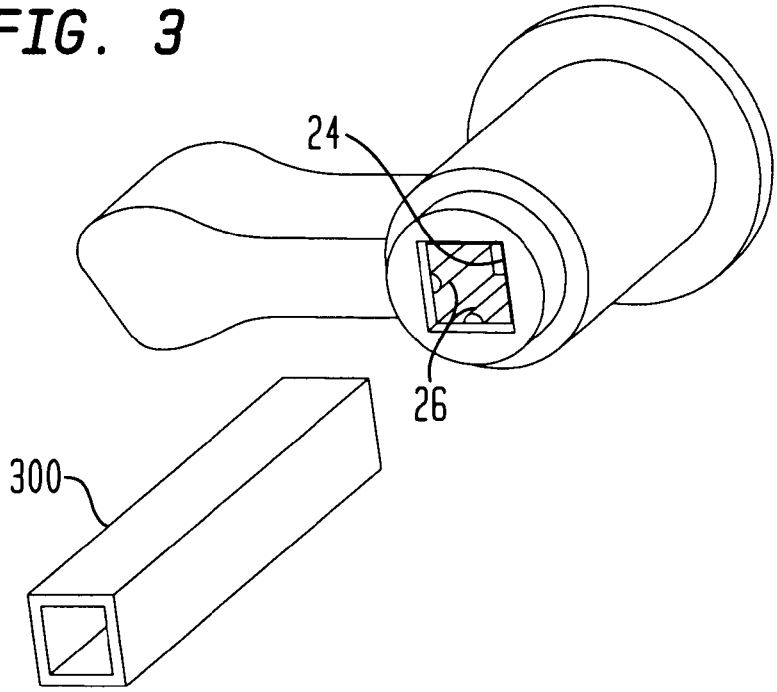
FIG. 3 shows a tubular trip bar before insertion into a drive slot having tapered ribs.

Referring to FIG. 3 which shows according to the present invention a crossbar and trip lever assembly comprising a tubular trip bar 22, which in this embodiment is a hollow square brass tube, before it is inserted into drive slot 24 of trip lever 22. Drive slot 24 has two tapered ribs 26 which extend longitudinally at least partially into drive slot 24.

Figure 4:
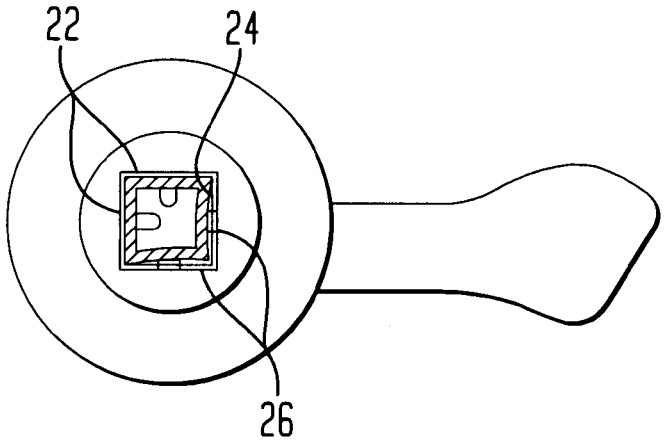
FIG. 4 is an end view of the assembled tubular bar deformed by tapered ribs within drive slot after the tubular bar has been press fit into the drive slot.

FIG. 4 is an end view of the assembled tubular trip bar 22 deformed by tapered ribs 26 within trip lever drive slot 24 after tubular bar 22 has been press fit into drive slot 24.

Thus, the disadvantages of prior art multi-piece designs including manufacturing tolerances where the trip bar mates loosely with the levers and those discussed in the Background of the Invention are avoided.

Other ductile materials which can be used for the crossbar include aluminum, copper, soft steel, and other conventionally known materials. Although the trip bar is shown and described as a hollow square tube, the walls of the tube may be virtually any shape and arranged to form a tube with a rectangular, triangular, octagonal, hexagonal or virtually any geometric cross-sectional area, but preferable not circular.

The trip lever may be made of thermoset polyester or phenolic and the trip lever drive slot shape should preferably correspond to the shape of the tubular crossbar but may be virtually any shape so long as the ribs sufficiently deform the crossbar.

Although the trip lever drive slot is described as having two or more ribs, in a preferred embodiment, two of the ribs are positioned on two adjacent walls of the drive slot.

While the present invention has been particularly shown and described with reference to preferred embodiments thereof, it will be understood by those skilled in the art that various changes in form and details may be made therein without departing from the spirit and scope of the invention.

In the claims:

1. A crossbar and trip lever assembly for a multi-pole electric circuit breaker, comprising:

(a) a longitudinally extending deformable tubular cross trip bar of hollow cross section and having an outer surface;

(b) a plurality of trip levers for causing at least two poles of the multi-pole electric circuit breaker to trip: each having a drive slot formed by interior walls with a plurality of tapered ribs partially extending longitudinally on the interior walls into the drive slot for compressing the outer surface of the trip bar and thereby securing the trip bar and trip levers together.

2. The crossbar and trip lever assembly of claim 1 where the cross trip bar is formed of a ductile material.

3. The crossbar and trip lever assembly as in claim 2 wherein the ductile material is brass.

4. The crossbar and trip lever assembly as in claim 3 wherein the hollow cross section of the cross trip bar is a square shape.

5. The crossbar and trip lever assembly as in claim 4 wherein at least one of the plurality of trip levers is made of a rigid plastic material.

6. The crossbar and trip lever assembly as in claim 5 wherein the rigid plastic material is selected from the group consisting of thermoset polyester and phenolic.

7. The crossbar and trip lever assembly as in claim 6 wherein each of two of the plurality of tapered ribs are positioned on adjacent interior walls of the drive slot.

8. The crossbar and trip lever assembly as in claim 2 wherein the ductile material is selected from the group consisting of aluminum, copper and soft steel.

9. The crossbar and trip lever assembly as in claim 8 wherein the hollow cross section of the cross trip bar has a shape selected from the group of regular geometric shapes consisting of triangular, rectangular, hexagonal and octagonal.

10. The crossbar and trip lever assembly as in claim 9 wherein at least one of the plurality of trip levers is made of a rigid plastic material.

11. The crossbar and trip lever assembly as in claim 10 wherein the rigid plastic material is selected from the group consisting of thermoset polyester and phenolic.

12. The crossbar and trip lever assembly as in claim 11 wherein each of two of the plurality of tapered ribs are positioned on adjacent interior walls of the drive slot.

13. The crossbar and trip lever assembly as in claim 2 wherein the hollow cross section of the cross trip bar has a shape selected from the group of regular geometric shapes consisting of triangular, rectangular, hexagonal and octagonal.

14. The crossbar and trip lever assembly as in claim 13 wherein at least one of the plurality of trip levers is made of a rigid plastic material.

15. The crossbar and trip lever assembly as in claim 14 wherein the rigid plastic material is selected from the group consisting of thermoset polyester and phenolic.

16. The crossbar and trip lever assembly as in claim 15 wherein each of two of the plurality of tapered ribs are positioned on adjacent interior walls of the drive slot.

17. The crossbar and trip lever assembly as in claim 1 wherein the hollow cross section of the cross trip bar has a shape selected from the group of regular geometric shapes consisting of triangular, rectangular, hexagonal and octagonal.

18. The crossbar and trip lever assembly as in claim 6 wherein at least one of the plurality of trip levers is made of a rigid plastic material.

19. The crossbar and trip lever assembly as in claim 17 wherein the deformable tubular cross trip bar is made of a ductile material selected from the group consisting of aluminum, copper, and soft steel.

20. The crossbar and trip lever assembly as in claim 19 wherein each of two of the plurality of tapered ribs are positioned on adjacent interior walls of the drive slot.

* * * * *